United States Patent [19]

Caselli

[11] Patent Number: 4,716,743

[45] Date of Patent: Jan. 5, 1988

[54] DEVICE FOR NEEDLE SELECTION IN A CIRCULAR KNITTING MACHINE

[75] Inventor: Fernando Caselli, Pontassieve, Italy

[73] Assignee: Officine Savio S.p.A., Pordenone, Italy

[21] Appl. No.: 826,248

[22] Filed: Feb. 5, 1986

[30] Foreign Application Priority Data

Feb. 8, 1985 [IT] Italy ..... 19449 A/85

[51] Int. Cl.[4] ..... D04B 15/78

[52] U.S. Cl. ..... 66/219; 66/222

[58] Field of Search ..... 66/75.2, 25, 219, 221, 66/222, 224

[56] References Cited

U.S. PATENT DOCUMENTS 4,048,816 9/1977 Scarffe ..... 66/219
4,226,096 10/1980 Lonati ..... 66/224

FOREIGN PATENT DOCUMENTS 3002538 8/1980 Fed. Rep. of Germany ..... 66/219
1603142 3/1971 France .
2122108 8/1972 France .
1368697 10/1974 United Kingdom ..... 66/219
2097824 11/1982 United Kingdom ..... 66/219

*Primary Examiner*—Wm. Carter Reynolds
*Attorney, Agent, or Firm*—Stevens, Davis, Miller & Mosher

[57] ABSTRACT

A method and device for needle selection in a circular knitting machine, by which the jacks are inactivated by causing a plurality of slides to approach the peripheral surface of the cylinder in order to come into contact with the jack selection butts. Slides are selectively retained in the approached position to implement the inactivation while allowing the other slides to withdraw. The inactivation is implemented starting approximately from the half revolution following that in which the approach has taken place. The selection action is effected by electromagnetic devices, the action of which is programmed revolution by revolution of the circular machine.

8 Claims, 6 Drawing Figures

DEVICE FOR NEEDLE SELECTION IN A CIRCULAR KNITTING MACHINE

This invention relates to circular knitting machines, and in particular to the selection of the operating needles.

It provides a device and method for effecting the selection of those needles which are required to grasp the threads from the feeds in order to form patterned hosiery articles.

Circular knitting machines are known to be constituted essentially by one or more cylinders which are grooved in their outer cylindrical surface.

The grooves constitute the guides for the needles which during their excursion form the stitch loops in cooperation with the sinkers.

Other details and features of the invention will stand out from the description given below by way of non-limitative example and with reference to the accompanying drawings, in which.

Figure 1:
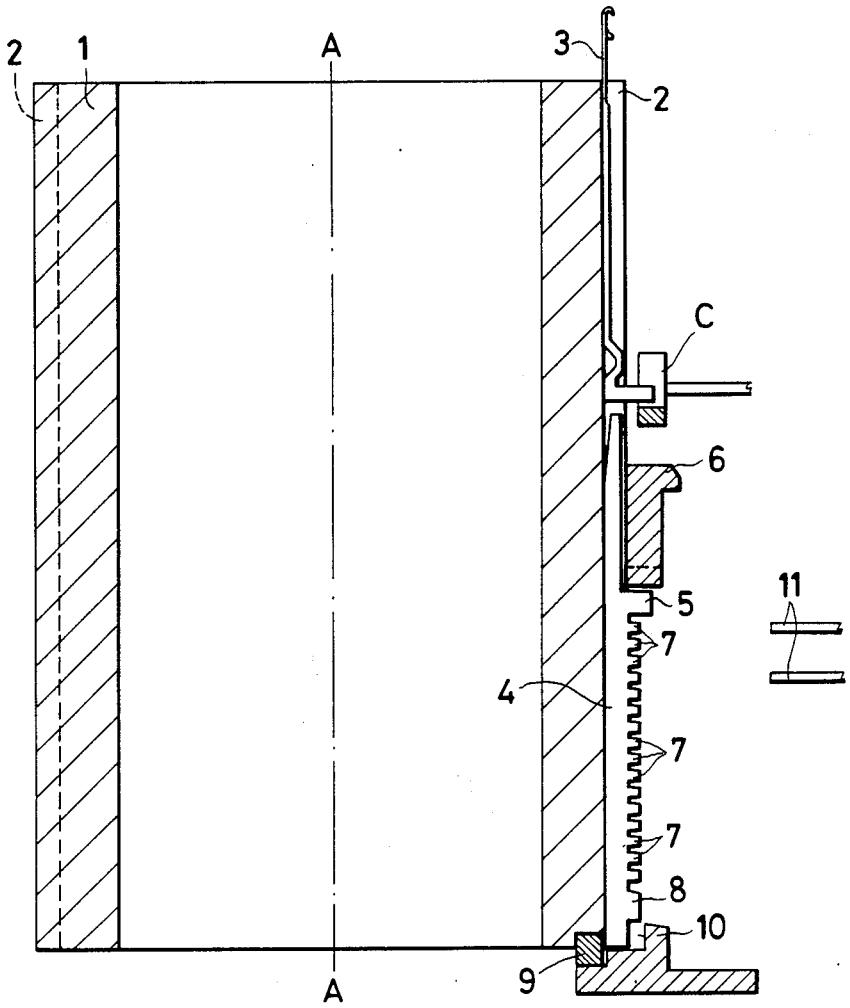
Fig.1 PRIOR ART
FIG. 1 depicts prior art showing a vertical sectional view of a needle cylinder of a circular knitting machine.

The basic stitch formation process is described hereinafter with reference to FIG. 1.

The cylinder is indicated by 1 and its grooves by 2.

The grooves are equal in number to the number of needles 3 which slide in them with reciprocating motion.

Generally there are between 200 and 400 grooves and needles per cylinder.

The needles operate with reciprocating motion between a maximum position and a minimum position into which they are moved by stitch formation cams, not shown.

The cylinder is rotated, leading to rotation of the needles which during their reciprocating motion are fed in a fixed angular position at the highest levels of their excursion by means of thread feeds. In producing hosiery articles, generally only a fraction of the available needles are used, these being used in the same manner and simultaneously, except for those portions of the article which comprise plain knitting, in which all the needles are operated, between said highest and lowest level, they being all fed with thread at each course of knitting and being all moved in the same manner.

When the machine is not producing plain knitting but instead other types of knitting (for example mesh knitting or general pattered knitting), some needles are required to produce stitch loops while the others are required either to rise to an intermediate level for taking up the thread without however casting off the preceding loops, thus forming tuck stitches, or to rise with delay so as not to take up the fed thread in a certain angular position and not to produce with it new stitches. In other words, a needle selection has to take place. This means that during each cylinder revolution, it has to be determined which and how many needles are to undergo a certain excursion and which and how many of the others are to undergo a certain different excursion, or indeed not to undergo any excursion.

This selection is controlled by the jacks 4 which slide in the same grooves as the needles which are located above them, so that they urge the needles upwards and move them to the highest level for grasping the thread.

When the jacks have moved the needle into the operating position, they withdraw from the needle butt and return downwards.

When the needle has grasped the thread and formed its stitch loop and is therefore at its minimum level, if it is not required to grasp another thread from another feed it remains at this level because its control jack is in its downward rest position.

The jack 4 has a particular shape which corresponds to a precise function. Although not shown on the drawing, it has a slight curvature—giving a bowed effect—in the direction orthogonal to the plane of the drawing. This curvature keeps the jack slightly forced into the groove and ensures its positioning accuracy and lack of vibration, so keeping it properly adhering to the groove walls but requiring the application of a certain force in order to cause it to move either axially or radially.

The shank of the jack comprises a plurality of projections in its lower part.

The highest projection 5, namely the upper guide butt, engages with its control cam 6 which moves projections downwards when jack 4 has completed its function of thrusting the needle 2.

Proceding downwards along the shank of the jack, there is a series of projections 7, known as selection butts or teeth, which serve for the actual selection which is described hereinafter, and are of a number sufficient to provide the required number of combinations for the selection. At the foot of the jack there is the lower guide butt 8.

Guide butt 8 cooperates with two fixed cams located about the base of the cylinder 1.

The cam 9 positions the butt 8 in the radial direction by urging it outwards so that it comes into engagement with the cam 10, which moves the butt 8 in the upward vertical direction.

All the jacks are urged outwards by the cam 9 so that they come into engagement with the cam 10 and are then raised so that they urge their needle into its operating position.

The purpose of the selection mechanism and procedure is to exclude from this totality of jacks all the jacks which control those needles which in order to form the required knitting must be raised only up to an intermediate level by means of cam C for producing tuck stitches. In the known art, the needle selection or inactivation mechanism is constituted by a plurality of levers 11 which come into contact with the butts 7 and return the jack into the groove so preventing it from making contact with the lifting cam 10.

The selection procedure therefore consists of providing contact between a certain number of levers 11 and a certain number of jacks 4 by way of the selection butts 7 located at the same height, by moving only some of the levers 11 towards the outer surface of the cylinder. If a certain jack has to be left in engagement with the cam 10 when one or more of the levers 11 have approached the cylinder 1, those butts which correspond to the level of these levers are removed from the jack.

The levers available for controlling the selection are generally of the same number as the number of available selection butts 7.

Figure 2:
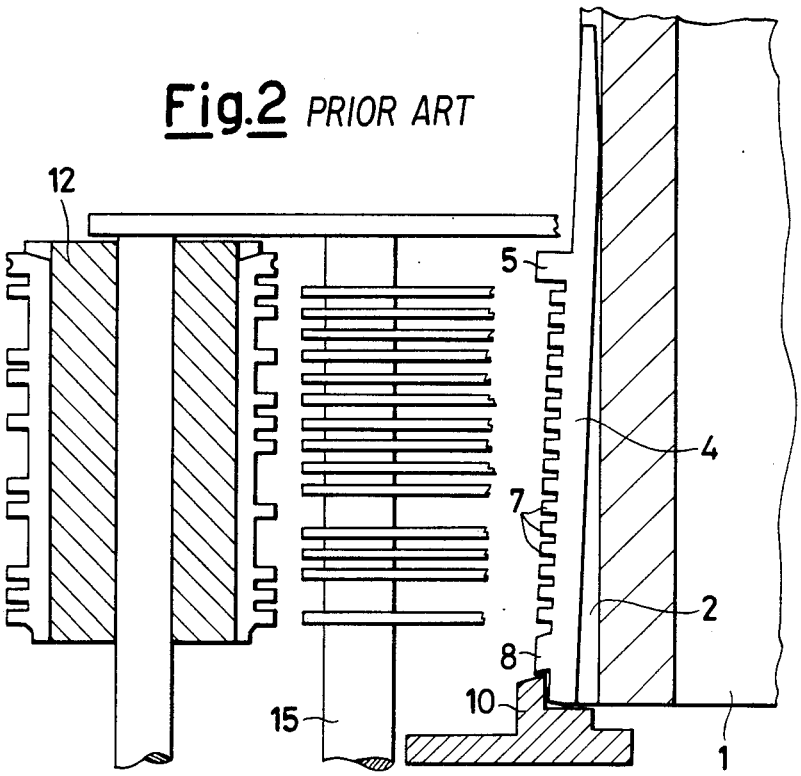
Fig.2 PRIOR ART
FIG. 2 depicts prior art showing a sectional view of a needle cylinder, jack, levers and cylindrical selection drum for controlling the selection of levers.
Figure 3:
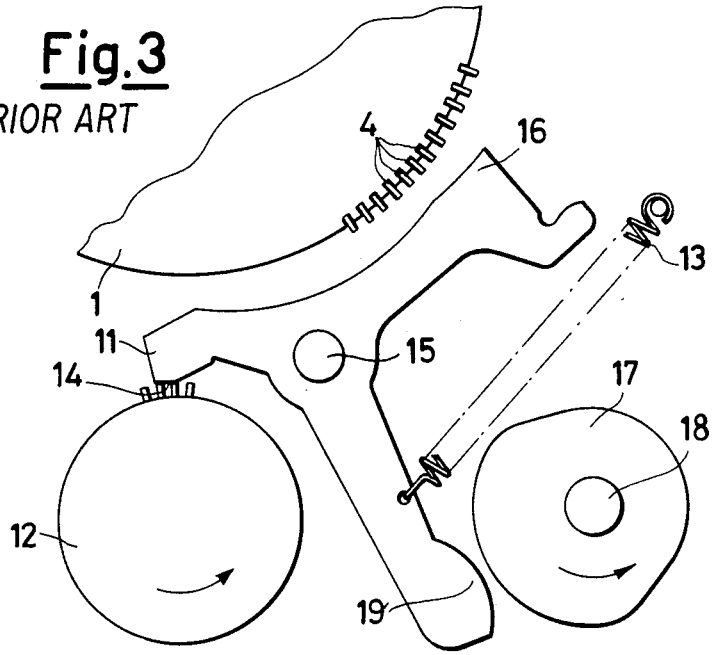
Fig.3 PRIOR ART
FIG. 3 depicts prior art showing a plan view of a needle cylinder, jacks, levers, cylindrical selection drum and cam.

The device and method for controlling the needle selection are described hereinafter with reference to FIGS. 2 and 3.

In the most widespread machines for producing mesh or patterned hosiery articles, this device is constituted by a cylindrical selection drum 12, on the generators of which there are disposed sequences of recesses and projections in a predetermined sequence and of a number corresponding to the number of control butts 7 available on the jacks. The selection levers 11 are stacked in a series of parallel planes orthogonal to the axis of the drum 12, which itself is parallel to the axis AA of the machine cylinder. The selection levers 11 are provided with a spring 13 for each lever, which keeps the part 14 in contact with the drum.

The drum 12 can rotate about its axis and present to the parts 14 of the levers 11 a determined sequence of recesses and projections, against which the parts 14 are urged to adhere by the springs 13. Consequently, a determined sequence of levers 11 encounters the cavity and rotates about the pin 15, and the corresponding parts 16 make contact with the jacks 4 housed in the cylinder grooves, so that those jacks from which the selection butt 7 lying at the same height as the lever has not been removed are urged into the grooves, thus making the corresponding needles inactive.

In contrast, those jacks from which the selection butt 7 at this height has been removed are not urged inwards, and the relative needles are raised into their operating position. A determined needle selection corresponds to each drum position by combining the recess and projection sequences on the drum 12 with the sequences of the butts 7 which have been left on or removed from each jack.

To change from one needle selection to the next programmed selection, the drum 12 is advanced through one step. As the selection change must take place on the jacks when they are in their rest position and not when they are undergoing their needle raising movement, the jacks are divided into two circular sectors (generally equal to 180° each, but in some cases the widths of the sectors can be different). In one sector all the butts 7 of the lower half are removed, and in the other sector all the butts 7 of the upper half are removed, the remaining half being used to determine the sequence of the needles which are to operate and not operate, i.e. the sequence of the jacks which are to be raised by the cam 10. This division criterion could also be changed, for example by removing all the even numbered butts 7 in one sector and all the odd numbered butts in the other, provided the division into two halves is respected.

Where possible, it is preferable to cause the selection levers 11 to enter their position of approach to the cylinder 1 when their parts 16 are in the respective semicircumference which is free of the jack butts 7, so as not to encounter any resistance in their approach. Where possible, this is done by dividing the pitch of each sequence of projections and recesses of the drum into two half pitches, which are undergone in the time it takes the cylinder to make one revolution, but of which one is offset from the other by 180°.

However, this arrangement halves the number of sequences available on the drum 12.

According to this preferred arrangement, the levers 11 become positioned with their parts 16 in proximity to the cylinder 1 during the preceding half revolution, and when they are positioned they interact with the butts 7 of the jacks located in the next semicircumference and effect the needle selection on this semicircumference.

In practice, the most used arrangements are those with a number of drums 12 and a number of groups of levers 11 equal to the number of thread feeds, as each thread feed can be used and the stitch assigned to it be formed, or alternatively equal to one half the thread feeds if one feed is to be selected in every two (mesh knitting). In machines of the known art, the drum 12 is moved by ratchet mechanisms, and this method has considerable applicational limits. If a hosiery article is to be produced in which the needle selection changes at each course of knitting, the drum should change selection at each machine revolution.

A widespread example of such articles are stockings formed from mesh knitting, to produce which the selection is changed every two courses. As modern circular machines operate at a speed of between 1000 and 1500 r.p.m., the drum 12 and its ratchet mechanisms would have to change the selection 1000–1500 times per minute by undergoing 2000–3000 actions per minute. This level of performance cannot be offered by the drum and its rachet machanisms, both because of its mechanical limits and because of the limited number of combinations available.

In the known art this drawback is overcome by introducing an additional modulation control. This consists of a series of cams 17 which rotate about a pin 18 parallel to the pin 15 at an angular speed coherent with that of the cylinder 1, in relation to the number of feeds (generally at half the angular speed for four thread feeds and at a quarter the angular speed for two thread feeds).

Said cams 17 engage with the part 19 of the lever 11, to introduce a supplementary modulation within the selection predetermined by the drum 12.

In other words, the cams 17 engage only with those levers 11 which are in the inactivating position, i.e. those closer to the surface of the cylinder 1 and to the cams 17. The cam 17 which engages with the lever 11 at its point 19 displaces the lever 11 from the cylinder 1 and enables that needle which has the selection butt 7 on its jack at the same height as the inactivating lever to return to operation. Other needle selection devices do not use jacks which oscillate in radial planes by action of the cams 9. Some of these devices, such as those of U.S. Pat. No. 3,004,424 and U.K. Pat. No. 950,189 in the name of Billi, comprise a slide interposed between the selection levers 11 and the jack butts, the slide having a surface which is inclined to the horizontal plane and engages with the jack butt to urge the jack upwards, and operating in accordance with the reverse criterion to the preceding devices.

In the needle selection methods of the prior art, the selection is made by presenting the members which implement the selection (levers, slides, tie rods and the like) in a predetermined mutual sequence. The methods available in the known art have considerable drawbacks. The first drawback, already described heretofore, is that selection methods using the drum 12 can only produce a limited selection rate, to the extent that the supplementary cam system 17 is necessary in order to introduce modulation—which overall is very limited—within a determined sequence when the selection has to be changed at high frequency or indeed at each course of knitting.

A further drawback derives from the fact that in its stepwise motion the drum 12 has fixed sequences and the selection change cannot be made with more steps each time. Thus if the type of knitted article is to be changed, the drum itself has to be modified so as to change the series of recess and projection sequences in accordance with the various required steps.

Thus each sequence change requires a modification to be made to the drum, and possibly also to the cylinder jacks.

The needle selection has to be determined for each course of knitting, and the recess and projection sequence for each drum step and the relative series of butts 7 to be removed or left for each jack also have to be planned and effected.

For each change of manufactured article, costs are therefore incurred in making and installing the new drum and the new set of jacks, in addition to the costs involved in the planning and the time for which the machine is shut down, which reduces its service factor or useful utilisation time.

A further considerable drawback is that each drum has a limited series of positions, i.e. of recess and projection sequences. For production of the normal type, jacks are used provided with 16 butts, of which 8 are available for creating the selection sequences on the needles of one semicircumference of the cylinder and the other 8 for creating the selection sequence on the needles of the other semicircumference. Again for production of normal type, the drum has 24 positions on its circumference, corresponding to 24 sequences. More complicated and costly drums containing up to 96 positions and 96 sequences are used for producing more complicated designs with machines of lower productivity.

The levers 11 have to attack a plurality of jacks with decision and precision during each revolution to overcome their centrifugal force. Thus the loading of the springs 13 is high, and the specific pressure on the points 14 and 19 is considerable and increases with the machine rotational speed. There are wear problems at these contacting parts.

The said same method of needle selection is enacted with the more recent devices consisting of slides, cams and electromagnetic retaining means.

One of such devices is described in the British patent appln. No. 2097824 in the name of Elitex. According to a first embodiment, said device consists of a series of horizontal jacks kept permanently pressed against the outer face of the cylinder by springs similar to the springs 13 of FIG. 3 which must bring to bear a force sufficient to thrust to the inside the butts of the plurality of jacks with which they simultaneously come into contact.

At each revolution these horizontal slides are deviated from the face of the cylinder through the intermediary of a series of oscillating levers controlled by a similar series of cams rotating coherently with the cylinder. During the rotation the cams are resisted by the action of pressure springs.

Provision is made for devices for retaining the slides in a retracted position. These linkage devices come into play only to keep the slides in a retracted position, proximal to the needles which are not to be inactivated, and are on the other hand maintained inactive and stationary by energized electromagnets until such time as their slides are to be retained in a retracted position. If one or more slides are to be retained, the energization of the corresponding electromagnets is interrupted the linkage is released and through the action of a pre-loaded spring moves to a position in which the slideis locked.

This technical solution appears to involve, for the reasons stated below, serious problems of application.

The shifting of the slides and locking linkages is entrusted to pre-loaded springs, involving considerable forces. The restoral of the locking linkages to the rest position is entrusted to the reenergized electromagnet when linkage and electromagnet are at a distance and, as the force of attraction of an electromagnetic is greatly affected by distance, the said restoral becomes problematical. The forces involved due to the preloaded springs, the inertia of the system overall and the return of the linkages make the said device unusable in positions where the jacks are inactivated. The slides are locked in a position of approach, i.e. in a position that inactivates the jacks, by means of a linkage substantially the same as the one according to the previous version, with the same electromagnetic retention device.

The disadvantages existing in the previous version are found again in this version of the device, and they make the use of the device non-viable in high-speed machines.

Another of such devices is described in the French Pat. No. 2,122,108, in the name of C. Terrot Soehne, and consists of an inactivating member constituted by a pushbutton kept pressed against the cylinder by a spring in a position that inactivates the jacks, said pushbutton being actuated reciprocatingly by a slide controlled by circular cams with eccentric pins.

The slides can be retained in an advanced or retracted position by locking-electromagnets either directly or through the intermediary of linkages.

The drawbacks existing in the previously considered prior arts also exist in the device according to French Pat. No. 2,122,108.

Such more recent devices overcome the problems deriving from the small number of possible drum positions for creating more complex patterns,but they do not overcome the problems relating to operating speed.

The present invention enables the aforesaid drawbacks to be obviated, and consists of a new needle selection method and a device for implementing it. The method according to the present invention consists of bringing a series of parallel slides capable of rectilinear reciprocating movement between withdrawn and approach positions with respect to the cylinder to a position of approach to the peripheral surface of the cylinder by a series of cams co-planar therewith, rotating at an angular velocity equal to that of the cylinder and selectively retaining slides by electromagnetically operated devices in the approach position which are to interact with the needle pushers or jack to be inactivated during the next half revolution of the cylinder while allowing the other slides to withdraw to the withdrawn position. The electromagnetically operated devices are constituted of electromagnets, oscillation cams, oscillation levers and springs on the oscillation levers. The oscillation cams produce an oscillation on the oscillation lever which causes one end of the lever to engage a slide to retain it in the approached position and the other end of the lever to approach an electromagnet which when energized locks the slide in the approached position to the cylinder so that the inactivation of the needle pushers or jacks may be accomplished. The invention is described with reference to FIGS. 4 and 5.

A series of cams 30, which rotate at the same angular velocity as the cylinder about the pivot 31 of vertical axis parallel to the axis AA of the cylinder 1, is in engagement with a series of slides 32 which face the cylinder 1 and are able to undergo reciprocating motion in a horizontal plane.

The contour of the cams 30 is shaped so as to cause the slide 32 to undergo its entire excursion of approach to and withdrawal from the cylinder 1 within an arc of between 120° and 180° of the rotation of said cam and thus of the cylinder, as these rotate at the same velocity.

The contour of the cams 30 which cause the slides 32 to approach the cylinder 1 is configured in its high zone as three separate portions. The first portion provides a gradual smooth connection between the circular sector of minor radius and the circular sector of major radius and constitutes the slide approach contour. The second portion extends with constant radius, namely the major radius, and constitutes the contour for maintaining the slide in its approached position. The third portion provides a smooth connection between the circular sector of major radius and the circular sector of minor radius, and constitutes the slide withdrawal contour.

The overall contour of the cams is thus divided into the following portions having the following widths:

withdrawn position maintaining portion: 180°–240° approach portion: 20°–40° approached position maintaining portion: 70°–130° withdrawal portion: 20°–40° The first of these portions listed constitutes the low contour zone and the remaining three constitute the high contour zone.

The slides 32 slide in guides 33 and are kept adhering to the contour of the cams 30 by springs or other thrust members.

Figure 4:
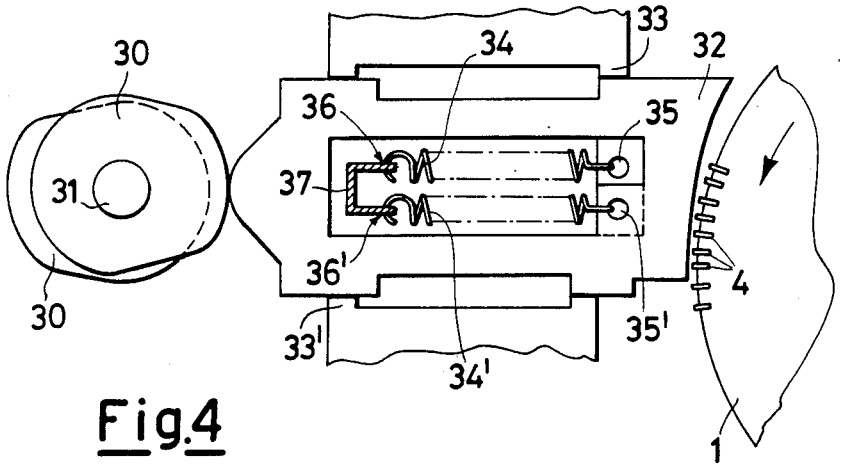
FIG. 4 is a plan view of one embodiment of the invention.
Figure 5:
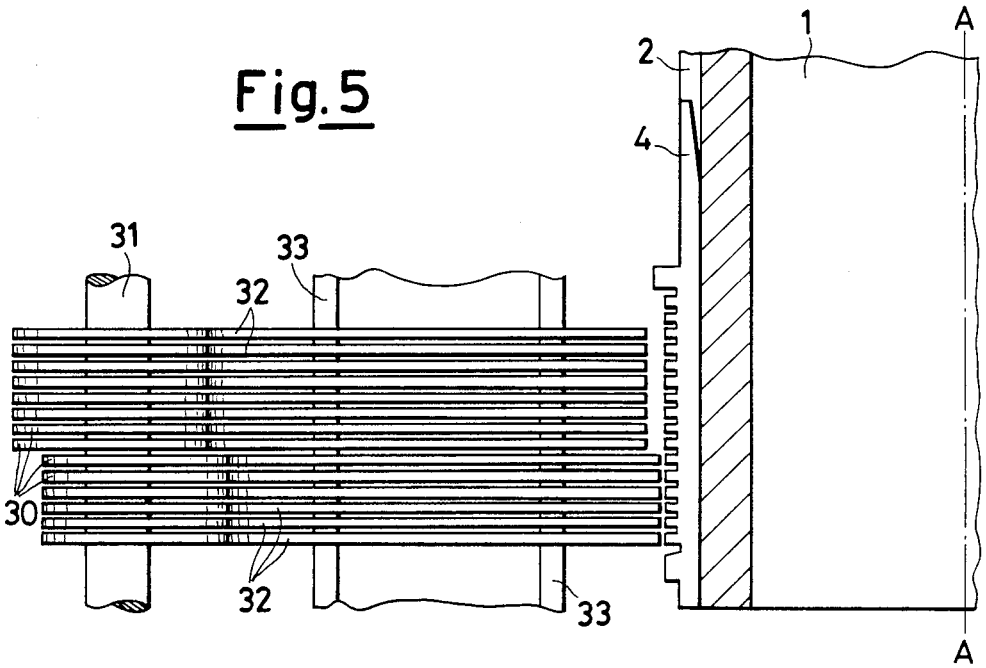
FIG. 5 is a vertical partial sectional view of the embodiment of FIG. 4.

In the embodiment of FIGS. 4 and 5 this adherence is provided by the spring 34 connected to the slide by means of the connection 35 and connected to a fixed part of the machine 37 by means of the connection 36. The loading of the spring 34 is proportional to the mass of the slide and is consequently small. In this respect this spring 34 is not required to oppose the thrust of the jacks 4 as in the case of the springs 13 of FIG. 3, but merely to ensure adherence between the slide 32 and cam 30.

As already seen in the case of known devices, the stacks of slides 32 and cams 30 are divided into two groups, of which one controls the selections in one semicircumference of jacks and the other group controls the selections in the other semicircumference, the two groups of slides 32 alternately approaching and withdrawing from the cylinder 1.

In the elevational view of FIG. 5, this division is in the form of an upper half which has approached the cylinder and a lower half which has withdrawn from the cylinder.

After half a revolution of the pivot 31, the two positions of approach to and withdrawal from the cylinder are reversed.

In this respect the selections are made as required on the semicircumference of the inoperative jacks. The approach cam 30, during the half revolution in which it is free from buts, pushes the set of slides 32 towards the cylinder 1, and they approach the cylinder surface to effect needle selection during the next half revolution by urging into the groove those jacks having butts at the same height as each slide 32.

That part of the slide 32 which projects towards the cylinder, and is designed to urge into the groove those jacks to be inactivated by acting on their selection butts, is configured with a smooth profile which enables it to smoothly engage with the butts and to gradually exert the inward thrust.

According to the present invention, this approach device is combined with a second series of members which either retain or do not retain the slides 32 in their approached position, so that they either enter or do not enter into contact with the selection butts 7 during the next half revolution.

In other words, all the slides 32 are made to approach the cylinder 1 during each revolution, but only some of them are selectively retained in this position during the half revolution following that of their approach, in order to urge the required jacks into the groove and render them inactive, whereas the other slides return to their withdrawn position during the half revolution in which the approach took place, and do not interact with the jacks in relationship with them.

Figure 6:
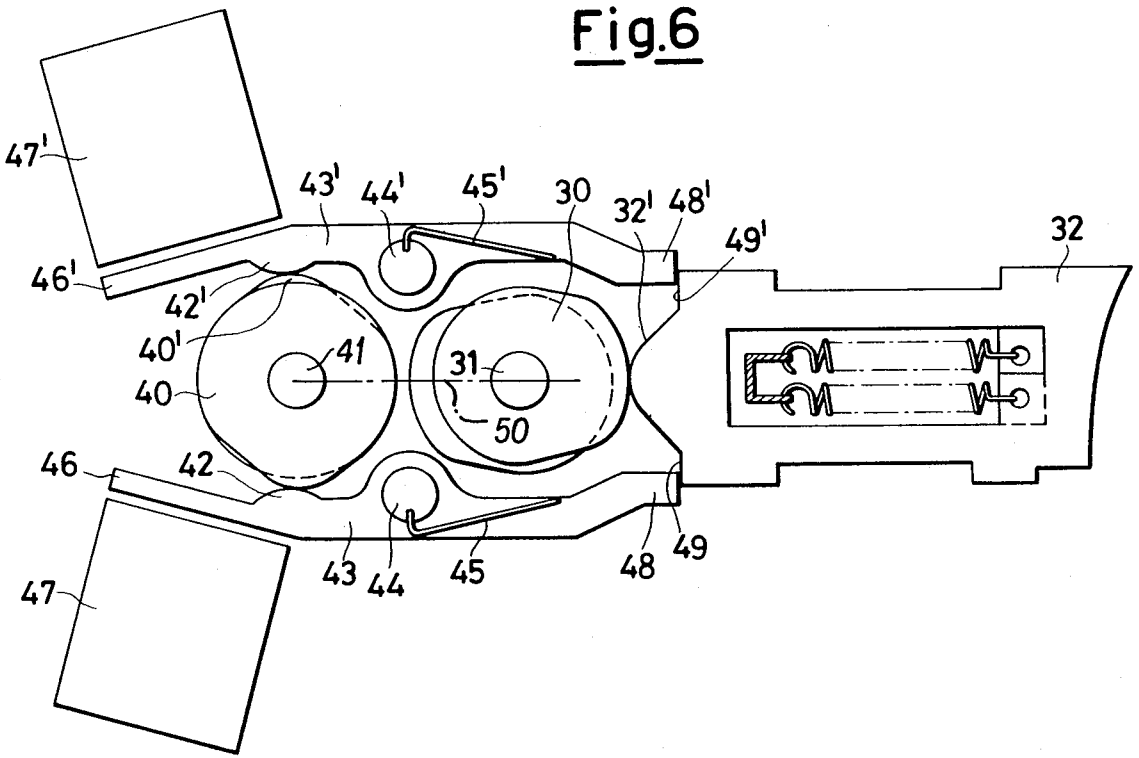
FIG. 6 is a plan view of a second embodiment of the invention.

FIG. 6 shows a second preferred embodiment of an electromagnetically operated device for selectively retaining the slides 32 in the approached position.

A second series of cams 40 (the reference numerals with indices and the dashed-line representations refer to the immediately underlying element in the stack formed from the series of cams and the levers controlled by them) rotate about the pivot 41, which is common to the series of cams 40 and 40', with an angular velocity equal to the angular velocity of the cams 30.

Each cam 40 is kept by means of a leaf spring 45 in contact at the point 42 with a lever 43 which oscillates about the pivot 44.

As can be seen from FIG. 6, the cam 40 is shaped with a high contour part having a much smaller angular width than the high contour part of the cam 30, as the entire oscillation of 43 must take place within the time during which the cam 30 presents to the slide 32 its contour portion of constant major radius.

In the embodiment of FIG. 6, the axes of symmetry of the cams 30 and 40 are offset by about 90°.

During the oscillatory motion of the lever 43, the end part 46 approaches and withdraws from the electromagnet 47, whereas the opposite end 48 engages in the slide 32 by means of its part 49. When the electromagnet 47 is energised, the part 46 already in contact with the electromagnet 47 is adheringly retained and the opposite end 48 is in engagement with the slide 32 to maintain it in its position of approach to the cylinder 1, so preventing the slide from returning rearwards when the cam 30 rotates to present to the slide its low contour part.

Likewise, when the electromagnet 47 is energised the cam 40 is no longer in contact with the point 42, and continues to rotate without effect, as does the cam 30.

When energisation of the magnet 47 is interrupted, the spring 45 returns the part 42 into contact with 40 and disengages the end 48 from the slide 32.

The lever 43 reassumes its oscillatory motion about the pivot 44, and the slide 32 reassumes its rectiliinear reciprocating motion.

It should be noted that the reaction thrust exerted by the jacks which are inactivated is opposed by the pivot 44 by virtue of the engagement of the end 48 of the lever 43.

In the embodiment of FIG. 6, the series of levers 43 and 43', with their relative connected members, are shown alternately on one side and on the other of the straight line 50 joining the axes of the two pivots 31 and 41 so as to have between two successive levers a gap equal to two butt pitches.

The space available in the vertical direction by this arrangement enables electromagnets of reliable performance to be housed without difficulty or interference.

The slides to be maintained in the position of approach to the surface of the cylinder 1 and those to be allowed to return to their withdrawn position are selected by energising only the required magnets in the two stacks of electromagnets 47 and 47'.

For example, if the first, seventh and fourteenth magnet are energised, the first, seventh and fourteenth slide will be retained in the position of approach to the cylinder 1.

Memorising the selection sequences and selection times on the basis of the cylinder revolution computation is effected by the operational memory installed on the machine, to which these data are transmitted either by the operator by finger entry or via a cable and serial line from a suitable external unit, possibly provided with magnetic supports (discs, tape cassettes etc.) for preservation and recording of the selection data for the various manufactured articles.

This type of programming allows a practically unlimited series of sequences, and these sequences can also be implemented by changing the needle selection course by course.

The energisation of the electromagnets 47 of FIG. 6 is determined by electrical connections—not shown—made to the machine control unit.

The needle selection device and method according to the present invention offer considerable advantages and enable the aforesaid drawbacks of devices of the known art to be obviated.

It is immediately apparent that the rapidity with which the selection can be varied is of a higher order than in the case of the conventional drum controlled mechanically by ratchet mechanisms. It corresponds to the rapidity of energisation of a low-power electromagnet.

There are no practical limits to the number of available selection sequences. The needle selection can be changed at each course of knitting even when operating at high speed. There is no longer the need to insert supplementary modulation devices such as the cams 17 of FIG. 3, as the device according to the invention is sufficient for all pattern requirements.

The friction and wear problems due to the considerable loading of the springs 13 which maintain the levers 11 in contact with the jack butts are eliminated. The springs 34 and 35 of the described embodiments of the invention are not required to exert considerable force, in that they are used only to ensure contact between the slides and levers and the cams, and a force of the order of one hundred grams weight in sufficient for this. In contrast, a force of some kilograms is required of the springs 13.

The work involved in preparing suitable drums 12 for each type of article to be produced is completely obviated. This is now done by simple finger-entry of the modifications into the machine control unit by the operator, or by loading new instructions from the said external unit.

The invention according to the present application brings considerable advantages also as compared to the more recent devices according to the cited prior art - which in fact employ some of the components of the device according to the present invention.

The device according to the invention has the advantage of comprising a much more straight forward lever, which is direct and precise, with the masses in reciprocating movement reduced in number and with their movements entrusted to rotating-cam actuation.

The electromagnetic locking devices are employed solely to retain the part with which they are confronted in a position of approach by the movement of the cam, and not to attract the said part. The complete cam-governed control has a precision of movement and synchronization that allow high cylinder rotation speeds and thus elevated productivity.

I claim:

1. An apparatus for needle selection in a circular knitting machine having jacks with selection butts projecting from the peripheral surface of the cylinder comprising a series of parallel slides capable of rectilinear reciprocating movement in planes orthogonal to the axis of the cylinder, a series of rotatable approach cams coplanar with said slides and contactible therewith, said approach cams being rotatable at an angular velocity coherent with the angular velocity of the cylinder to bring said slides to a position of approach to the peripheral surface of the cylinder, and electromagnetically operated devices to selectively retain those slides which are to interact in a particular revolution of the cylinder with the butts of the needle pushers or jacks, said interacting slides being brought to a position of approach to the peripheral surface of the cylinder in the half-revolution in which the surface of the cylinder is free from selection butts to perform the selection starting from the subsequent half-revolution, said series of cams being divided into two rotating cam groups in which a high-contour cam part effecting the approach of the cylinder is offset in open group by 180° from a corresponding part in the other group, said electromagnetically operated devices for selectively retaining the slides in the approached position being constituted by a plurality of electromagnets, oscillation cams, oscillation levers and springs on said oscillation levers, said oscillation cams being rotatable about a pivot having an axis parallel to the axis of the approach cams and being rotatable at the same angular velocity as the approach cams, said oscillation levers being biased by said springs to contact said oscillation cams, said oscillation levers being oscillatable in the same planes as the slides, said oscillation cams producing in said oscillation levers an oscillation which causes one of the two opposite ends of each lever to engage the coplanar slide to retain it in the approached position to the cylinder, and the other end to approach an electromagnet which when energised retains said oscillation lever magnetically locked to said electromagnet, said locking action maintaining the coplanar slide in an approached position to the cylinder and no longer in adherence to the approach cam, and maintaining the oscillating lever fixed and no longer in adherence to the oscillation cam.

2. The device for needle selection in a circular knitting machine as claimed in claim 1, wherein the oscillation cams have a shape analogous to that of the approach cams, but with their high-contour part of narrower overall width than the width of the contour portion of constant major radius of the approach cam as they have to cause the oscillating levers to undergo their entire oscillation within the time during which the corresponding approach cam presents its contour portion of constant major radius to the slide, said width of the approach cam being between 70° and 130° in total.

3. The apparatus of claim 1, wherein the contours of the oscillation cams and of the corresponding approach cams have their axes of symmetry substantially offset by 90°.

4. The device for needle selection in a circular knitting machine as claimed in claim 1, wherein said oscillation cams, oscillation levers and locking electromagnets are disposed adjacent to each other alternately on one side and the other of a line joining the axes of the pivots of the oscillation cams and of the approach cams.

5. The apparatus of claim 2, characterized in that the contours of the oscillation cams and of the corresponding approach cams have their axes of symmetry substantially offset by 90°.

6. The apparatus of claim 2, wherein said oscillation cams, oscillation levers and locking electromagnets are disposed adjacent to each other alternately on one side and the other of a line joining the axes of the pivots of the oscillation cams and of the approach cams.

7. The apparatus of claim 3, wherein said oscillation cams, oscillation levers and locking electromagnets are disposed adjacent to each other alternately on one side and the other of a line joining the axes of the pivots of the oscillation cams and of the approach cams.

8. An apparatus for needle selection in a circular knitting machine having jacks with selection butts projecting from the peripheral surface of the cylinder comprising a series of parallel slides capable of rectilinear reciprocating movement in planes orthogonal to the axis of the cylinder, a series of rotatable approach cams coplanar with said slides and contactible therewith, said approach cams being rotatable at an angular velocity coherent with the angular velocity of the cylinder to bring said slides to a position of approach to the peripheral surface of the cylinder, and electromagnetically operated devices to selectively retain those slides which are to interact in a particular revolution of the cylinder with the butts of the needle pushers or jacks, said interacting slides being brought to a position of approach to the peripheral surface of the cylinder in the half-revolution in which the surface of the cylinder is free from selection butts to perform the selection starting from the subsequent half-revolution, said series of cams being divided into two rotating cam groups in which a high-contour cam part effecting the approach of the cylinder is offset in one group by 180° from a corresponding part in the other group, said high-contour part of the slide approach cams being configured as three separate portions, of which the first approach portion has a width of between 20° and 40°, the second approached position maintaining portion has a width of between 70° and 130°, and the third withdrawal portion has a width of between 20° and 20°, said high-contour part constituted by the three foresaid portions having a total width of between 120° and 180°, said electromagnetically operated devices for selectively retaining the slides in the approached position being constituted by a plurality of electromagnets, oscillation cams, oscillation levers and springs on said oscillation levers, said oscillation cams being rotatable about a pivot having an axis parallel to the axis of the approach cams and being rotatable at the same angular velocity as the approach cams, said oscillation levers being biased by said springs to contact said oscillation cams, said oscillation cams being oscillatable in the same planes as the slides, said oscillation cams producing in said oscillating levers an oscillation which causes one of the two opposite ends of each lever to engage the coplanar slide to retain it in the approached position to the cylinder, and the other end to approach an electromagnet which when energized retains said oscillation lever magnetically locked to said electromagnet, said locking action maintaining the coplanar slide in an approached position to the cylinder and no longer in adherence to the approach cam, and maintaining the oscillating lever fixed and no longer in adherence to the oscillation cam.

* * * * *